US007582399B1

(12) United States Patent
Mishra et al.

(10) Patent No.: US 7,582,399 B1
(45) Date of Patent: Sep. 1, 2009

(54) IMAGING MEMBER HAVING NANO POLYMERIC GEL PARTICLES IN VARIOUS LAYERS

(75) Inventors: Satchidanand Mishra, Webster, NY (US); Yuhua Tong, Webster, NY (US); Kathleen Carmichael, Williamson, NY (US); Markus Silvestri, Fairport, NY (US); Susan Vandusen, Williamson, NY (US); Chieh-Min Cheng, Rochester, NY (US); Huoy-Jen Yuh, Pittsford, NY (US); Cindy Chen, Rochester, NY (US); Lanhui Zhang, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 414 days.

(21) Appl. No.: 11/472,740

(22) Filed: Jun. 22, 2006

(51) Int. Cl.
*G03G 5/047* (2006.01)

(52) U.S. Cl. ..... 430/57.1; 430/58.5; 430/58.65; 430/58.75; 430/58.8; 430/58.85; 430/66; 430/96

(58) Field of Classification Search ..... 430/57.1, 430/58.5, 58.65, 58.75, 58.8, 58.85, 66, 96
See application file for complete search history.

(56) References Cited

U.S. PATENT DOCUMENTS

| | | | | |
|---|---|---|---|---|
| 3,121,006 | A | | 2/1964 | Middleton et al. |
| 3,820,989 | A | | 6/1974 | Rule et al. |
| 3,837,851 | A | | 9/1974 | Shattuck et al. |
| 3,895,944 | A | | 7/1975 | Wiedemann et al. |
| 4,150,987 | A | | 4/1979 | Anderson et al. |
| 4,245,021 | A | | 1/1981 | Kazami et al. |
| 4,256,821 | A | | 3/1981 | Enomoto et al. |
| 4,265,990 | A | | 5/1981 | Stolka et al. |
| 4,278,746 | A | | 7/1981 | Goto et al. |
| 4,286,033 | A | | 8/1981 | Neyhart et al. |
| 4,291,110 | A | | 9/1981 | Lee |
| 4,297,426 | A | | 10/1981 | Sakai et al. |
| 4,315,982 | A | | 2/1982 | Ishikawa et al. |
| 4,338,387 | A | | 7/1982 | Hewitt |
| 4,338,388 | A | | 7/1982 | Sakai et al. |
| 4,385,106 | A | | 5/1983 | Sakai |
| 4,387,147 | A | | 6/1983 | Sakai |
| 4,399,207 | A | | 8/1983 | Sakai et al. |
| 4,399,208 | A | | 8/1983 | Takasu et al. |
| 4,587,189 | A | | 5/1986 | Hor et al. |
| 4,654,284 | A | | 3/1987 | Yu et al. |
| 4,664,995 | A | | 5/1987 | Horgan et al. |
| 4,840,861 | A | * | 6/1989 | Staudenmayer et al. .. 430/58.75 |
| 4,988,597 | A | | 1/1991 | Spiewak et al. |
| 5,112,711 | A | * | 5/1992 | Nguyen et al. ..... 430/59.5 |
| 5,244,762 | A | | 9/1993 | Spiewak et al. |
| 5,576,130 | A | * | 11/1996 | Yu et al. ..... 430/59.1 |
| 5,756,245 | A | | 5/1998 | Esteghamatian et al. |
| 6,214,514 | B1 | | 4/2001 | Evans et al. |

(Continued)

OTHER PUBLICATIONS

Jun. 22, 2006, Mishra, et al.

*Primary Examiner*—Hoa V Le
(74) *Attorney, Agent, or Firm*—Pillsbury Winthrop Shaw Pittman LLP

(57) ABSTRACT

Imaging members useful in electrostatographic apparatuses, including printers, copiers, other reproductive devices, and digital apparatuses. More particularly, imaging members having nano polymeric gel particles embedded into one or more layers of the imaging member that provide for increased mechanical strength and improved wear.

23 Claims, 2 Drawing Sheets

U.S. PATENT DOCUMENTS

2003/0067097 A1* 4/2003 Yu et al. ..... 264/345
2004/0115545 A1 6/2004 Horgan et al.
2004/0126684 A1 7/2004 Horgan et al.
2004/0151999 A1* 8/2004 Mishra et al. ..... 430/58.3
2005/0053854 A1 3/2005 Pai et al.
2005/0164107 A1* 7/2005 Toriyama et al. ..... 430/73
2005/0175911 A1* 8/2005 Tamoto et al. ..... 430/58.7
2006/0286474 A1* 12/2006 Morita et al. ..... 430/59.5
2007/0134570 A1* 6/2007 Hartman et al. ..... 430/58.45

* cited by examiner

IMAGING MEMBER HAVING NANO POLYMERIC GEL PARTICLES IN VARIOUS LAYERS

BACKGROUND

Herein disclosed are imaging members useful in electrostatographic apparatuses, including printers, copiers, other reproductive devices, and digital apparatuses. Some specific embodiments are directed to imaging members that have nano-size particles serving as fillers dispersed or contained in one or more layers of the imaging member. The nano-size particles provide, in some embodiments, an imaging member with a transparent, smooth, and less friction-prone surface. In addition, the nano-size particles may provide a imaging member with longer life and reduced marring, scratching, abrasion and wearing of the surface. Furthermore, the nano-size particle filler has good dispersion quality in the selected binder and reduced particle porosity. Thus, incorporation of the nano-size particles into the imaging member provides for increased mechanical strength and improved wear.

In electrostatographic reproducing apparatuses, including digital, image on image, and contact electrostatic printing apparatuses, a light image of an original to be copied is typically recorded in the form of an electrostatic latent image upon a imaging member and the latent image is subsequently rendered visible by the application of electroscopic thermoplastic resin particles and pigment particles, or toner. Electrophotographic imaging members may include imaging members (photoreceptors) which are commonly utilized in electrophotographic (xerographic) processes, in either a flexible belt or a rigid drum configuration. Other members may include flexible intermediate transfer belts that are seamless or seamed, and usually formed by cutting a rectangular sheet from a web, overlapping opposite ends, and welding the overlapped ends together to form a welded seam. These electrophotographic imaging members comprise a photoconductive layer comprising a single layer or composite layers.

The term "electrostatographic" is generally used interchangeably with the term "electrophotographic." In addition, the terms "charge blocking layer" and "blocking layer" are generally used interchangeably with the phrase "undercoat layer."

One type of composite photoconductive layer used in xerography is illustrated in U.S. Pat. No. 4,265,990 which describes a imaging member having at least two electrically operative layers. One layer comprises a photoconductive layer which is capable of photogenerating holes and injecting the photogenerated holes into a contiguous charge transport layer (CTL). Generally, where the two electrically operative layers are supported on a conductive layer, the photoconductive layer is sandwiched between a contiguous CTL and the supporting conductive layer. Alternatively, the CTL may be sandwiched between the supporting electrode and a photoconductive layer. Imaging members having at least two electrically operative layers, as disclosed above, provide excellent electrostatic latent images when charged in the dark with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a member such as paper.

In the case where the charge-generating layer (CGL) is sandwiched between the CTL and the electrically conducting layer, the outer surface of the CTL is charged negatively and the conductive layer is charged positively. The CGL then should be capable of generating electron hole pair when exposed image wise and inject only the holes through the CTL. In the alternate case when the CTL is sandwiched between the CGL and the conductive layer, the outer surface of CGL layer is charged positively while conductive layer is charged negatively and the holes are injected through from the CGL to the CTL. The CTL should be able to transport the holes with as little trapping of charge as possible. In flexible web like imaging member the charge conductive layer may be a thin coating of metal on a thin layer of thermoplastic resin.

As more advanced, higher speed electrophotographic copiers, duplicators and printers were developed, however, degradation of image quality was encountered during extended cycling. The complex, highly sophisticated duplicating and printing systems operating at very high speeds have placed stringent requirements including narrow operating limits on imaging members. For example, the numerous layers used in many modern photoconductive imaging members must be highly flexible, adhere well to adjacent layers, and exhibit predictable electrical characteristics within narrow operating limits to provide excellent toner images over many thousands of cycles. One type of multilayered imaging member that has been employed as a belt in electrophotographic imaging systems comprises a substrate, a conductive layer, an optional blocking layer, an optional adhesive layer, a CGL, a CTL and a conductive ground strip layer adjacent to one edge of the imaging layers, and an optional overcoat layer disposed on the charge transport layer. Such an imaging member may further comprise an anti-curl back coating layer on the side of the substrate opposite the side carrying the conductive layer, support layer, blocking layer, adhesive layer, CGL, CTL and other layers.

In a typical machine design, a flexible imaging member belt is mounted over and around a belt support module comprising numbers of belt support rollers, such that the top outermost charge transport layer is exposed to all electrophotographic imaging subsystems interactions. Under a normal machine imaging function condition, the top exposed charge transport layer surface of the flexible imaging member belt is constantly subjected to physical/mechanical/electrical/chemical species actions against the mechanical sliding actions of cleaning blade and cleaning brush, electrical charging devices, corona effluents exposure, developer components, image formation toner particles, hard carrier particles, receiving paper, and the like during dynamic belt cyclic motion. These machine subsystem interactions against the surface of the charge transport layer have been found to consequently cause surface contamination, scratching, abrasion-all of which can lead to rapid charge transport layer surface wear problems. Thus, a major factor limiting imaging member life in copiers and printers, is wear and how wear affects the multiple layers of the imaging member. For example, the durability of the charge transport and overcoat, and the ability of these layers to resist wear will greatly impact the imaging member life.

Many current imaging members have their top charge transport layers comprised of dispersed charge transport molecules or components in polycarbonate binders. The charge transport molecule or components may be, for example, represented by the following structure:

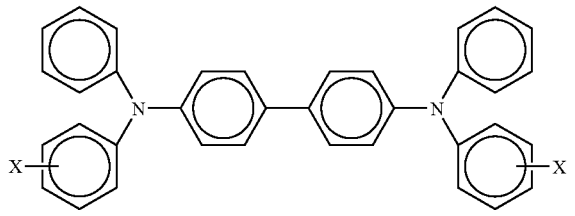

wherein X is selected from the group consisting of alkyl, alkoxy, and halogen. In embodiments the alkyl and alkoxy contain from about 1 to about 12 carbon atoms. In other embodiments, the alkyl contains from about 1 to about 5 carbon atoms. In yet another embodiment, the alkyl is methyl. In an embodiment, the charge transport molecule is (N,N'-diphenyl-N,N'-bis(3-methylphenyl)-(1,1'-biphenyl-)-4,4'diamine).

In order to provide a sufficient charge transporting capability, the charge transport molecule loading level is typically very high, for example, around 43 percent to 50 percent by weight of the total weight of the charge transport layer. High charge transport molecule content leads to poor physical properties of the device, for example, a decrease in mechanical strength. Moreover, charge transport molecule content constitutes one of the most expensive components of the imaging member. Consequently, high charge transport molecule content increases the cost of imaging member devices. Thus, maintaining sufficient charge transporting capability in current imaging members not only increases the associated costs but also decreases the mechanical strength of the imaging member.

The overcoat layer provides an outer level of protection on the imaging member and may help bolster wear resistance and scratch resistance of the charge transport layer in the print engine. Because the overcoat layer is one of the outermost layers of the imaging member, it is subjected to more wear and friction than some of the other layers. Thus, how well the overcoat layer is maintained will greatly affect imaging member life.

Another limiting factor is associated with the anti-curl back coating layer. In the production of multilayered imaging members, the drying/cooling process used to form the layers will often cause upward curling of the multiple layers. This upward curling is a consequence of thermal contraction mismatch between the CTL and the substrate support. Curling of a imaging member web is undesirable because it hinders fabrication of the web into cut sheets and subsequent welding into a belt. To offset the curling, an anti-curl back coating is applied to the backside of the flexible substrate support, opposite to the side having the charge transport layer, to render the imaging member web stock with desired flatness. Common anti-curl back coating formulations, however, do not always providing satisfying dynamic imaging member belt performance result under a normal machine functioning condition; for example, exhibition of anti-curl back coating wear and its propensity to cause electrostatic charging-up are the frequently seen problems to prematurely cut short the service life of a belt which requires frequent and costly replacements. The electrostatic charge build up is due to contact friction between the anti-curl layer and the backer bars, which increases the friction and thus requires higher torque to pull the belts. Because the anti-curl back coating is an outermost exposed layer and has high surface contact friction when it slides over the machine subsystems of belt support module, such as rollers, stationary belt guiding components, and backer bars, during dynamic belt cyclic function, these mechanical sliding interactions against the belt support module components not only exacerbate anti-curl back coating wear, but also cause the relatively rapid wearing away of the anti-curl layer which produces debris. Such debris scatters and deposits on critical machine components such as lenses, corona charging devices and the like, thereby adversely affecting machine performance. Thus, how well the anti-curl layer is maintained will greatly affect imaging member life.

Therefore, there is a need for an alternative design of the imaging member in which mechanical wear can be reduced while improving the electrical properties in the various layers, such as the overcoat layer, anti-curl back coating layer and charge transport layer, without high costs.

BRIEF SUMMARY

Embodiments include an imaging member, comprising a substrate, a charge generating layer disposed on the substrate, a charge transport layer disposed on the charge generating layer, an overcoat layer disposed on the charge transport layer, an anti-curl back coating layer disposed on the substrate opposite to the charge transport layer, and optionally a ground strip layer disposed on one edge of the imaging member, wherein at least one of the charge transport layer, overcoat layer, anti-curl back coating layer, and ground strip layer is formed from a resin binder dissolved in a solvent, wherein the resin binder comprises a polycarbonate resin embedded with nano polymeric gel particles.

Another embodiment provides an imaging member, comprising a substrate, a charge transport layer disposed on the substrate having (N,N'-diphenyl-N,N'-bis(3-methylphenyl)-(1,1'-biphenyl-)-4,4'diamine), an overcoat layer disposed on the charge transport layer, an anti-curl back coating layer disposed on the substrate opposite to the charge transport layer, and optionally a ground strip layer disposed on one edge of the imaging member, wherein at least one of the charge transport layer, overcoat layer, anti-curl back coating layer, and ground strip layer is formed from a resin binder dissolved in a solvent, wherein the resin binder comprises a polycarbonate resin embedded with nano polymeric gel particles, the nano polymeric particles being crosslinked polystyrene-n-butyl acrylate copolymers.

Yet another embodiment provides an image forming apparatus for forming images on a recording medium comprising an imaging member having a charge retentive surface for receiving an electrostatic latent image thereon, wherein the imaging member comprises a substrate, a charge generating layer disposed on the substrate, a charge transport layer disposed on the charge generating layer, an overcoat layer disposed on the charge transport layer, an anti-curl back coating layer disposed on the substrate opposite to the charge transport layer, and optionally a ground strip layer disposed on one edge of the imaging layer, wherein at least one of the charge transport layer, overcoat layer, anti-curl back coating layer, and ground strip layer is formed from a resin binder dissolved in a solvent, wherein the resin binder comprises a polycarbonate resin embedded with nano polymeric gel particles, a development component adjacent to the charge-retentive surface for applying a developer material to the charge-retentive surface, a transfer component adjacent to the charge retentive-surface for transferring the developed image from the charge-retentive surface to a copy substrate, and a fusing component adjacent to the copy substrate for fusing the developed image to the copy substrate.

BRIEF DESCRIPTION OF THE DRAWINGS

The above embodiments will become apparent as the following description proceeds upon reference to the drawings, which include the following figures.

DETAILED DESCRIPTION

Figure 1:
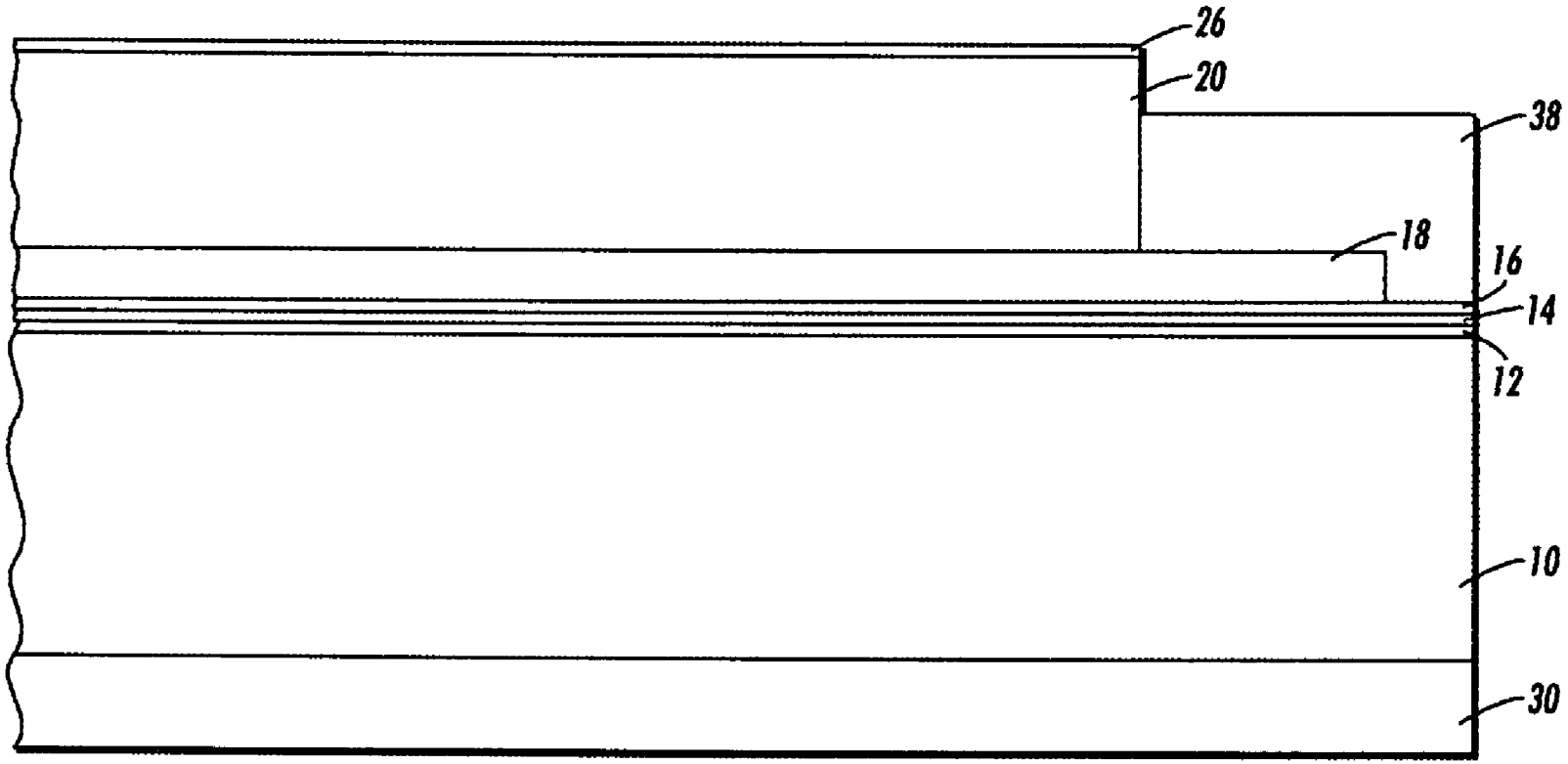
FIG. 1 is a cross-section view of a multilayered electrophotographic imaging member of flexible belt configuration according to an embodiment.

In the following description, reference is made to the accompanying drawings which form a part hereof and which illustrate several embodiments. It is understood that other embodiments may be utilized and structural and operational changes may be made without departing from the scope of the present embodiments.

The present embodiments relate to the use of embedding nano-size gel particles into a layer or layers of a imaging member to increase wear resistance and promote longer life of the imaging member. In embodiments, a imaging member with nano-size particles as a filler exhibits good dispersion quality in the selected binder, and reduced particle porosity.

A method of producing such nanoparticles is disclosed in commonly assigned and co-pending U.S. Patent Application Ser. No. 11/472,715 entitled "Methods for Producing Nanoparticles," to Mishra et al., filed Jun. 22, 2006 and use of such produced nanoparticles is disclosed in commonly assigned and co-pending U.S. Patent Application Ser. No. 11/472,757 entitled "Imaging Member having Nano-size Phase Separation in Various Layers," to Mishra et al., filed Jun. 22, 2006, which are herein incorporated by reference.

In accordance with embodiments, nano polymeric gel particles are dispersed or embedded into and embedded in the matrix of a binder polymer. This matrix is subsequently used to form a layer of an imaging member, to impart mechanical strength and improve electrical properties in that layer. The layer may be, for example, a charge transport layer, an overcoat layer, an anti-curl back coating layer or a ground strip layer.

For example, such nano polymeric gel particles can be incorporated into a charge transport layer to achieve high performance imaging members which are able to operate with much less charge transport molecules but still retain good mobility and electrical properties. In one embodiment, nano-polymeric gel particles are dispersed into a polycarbonate charge transport layer. For example, a cross-linked polystyrene-n-butyl acrylate copolymer may be used as such nano-polymeric gel particles. These imaging members are able to exhibit high performance and use much less charge transport molecule without affecting the charge transport mobility due to the excluded volume effect provided by the inert nanoparticles.

In other embodiments, the nano polymeric gel particles are dispersed in a polycarbonate binder used to form an overcoat layer. In specific embodiments, a cross-linked polystyrene-n-butyl acrylate copolymer may be used as such nano-polymeric gel particles. Imaging members including a protective overcoat layer with the nano-polymeric gel nanoparticles improved mechanical strength and electrical properties.

In yet other embodiments, the nano polymeric gel particles comprising cross-linked polystyrene-n-butyl acrylate are dispersed in a polycarbonate binder used to form an anti-curl back coating layer or a ground strip layer. Incorporation of the nano polymeric gel particles into these layers has shown to increase mechanical strengths of the layers.

In embodiments, the polycarbonate resin used can be bisphenol-Z-polycarbonate (PCZ) or bisphenol-A-polycarbonate or mixtures thereof. The different polycarbonate resins can be used interchangeably, as well as in mixtures, in the above described imaging member layers.

The nano polymeric gel particles can be present in one or more of the above layers, as well as be present in each of the layers. In embodiments, the nano-particles may be present in the respective layer from about 0.1 percent to about 30 percent weight of the total weight of the respective layer.

The embodiments of the present imaging member are utilized in an electrophotographic image forming member for use in an electrophotographic imaging process. As explained above, such image formation involves first uniformly electrostatically charging the imaging member, then exposing the charged imaging member to a pattern of activating electromagnetic radiation such as light, which selectively dissipates the charge in the illuminated areas of the imaging member while leaving behind an electrostatic latent image in the non-illuminated areas. This electrostatic latent image may then be developed at one or more developing stations to form a visible image by depositing finely divided electroscopic toner particles, for example, from a developer composition, on the surface of the imaging member. The resulting visible toner image can be transferred to a suitable receiving member, such as paper. The imaging member is then typically cleaned at a cleaning station prior to being recharged for formation of subsequent images.

Alternatively, the developed image can be transferred to another intermediate transfer device, such as a belt or a drum, via the transfer member. The image can then be transferred to the paper by another transfer member. The toner particles may be transfixed or fused by heat and/or pressure to the paper. The final receiving medium is not limited to paper. It can be various substrates such as cloth, conducting or non-conducting sheets of polymer or metals. It can be in various forms, sheets or curved surfaces. After the toner has been transferred to the imaging member, it can then be transfixed by high pressure rollers or fusing component under heat and/or pressure.

An exemplary embodiment of a multilayered electrophotographic imaging member of flexible belt configuration is illustrated in FIG. 1. The exemplary imaging member includes a support substrate 10 having an optional conductive surface layer or layers 12 (which may be referred to herein as a ground plane layer), optional if the substrate itself is conductive, a hole blocking layer 14, an optional adhesive interface layer 16, a charge generating layer 18 and a charge transport layer 20, and optionally one or more overcoat and/or protective layer 26. The charge generating layer 18 and the charge transport layer 20 forms an imaging layer described here as two separate layers. It will be appreciated that the functional components of these layers may alternatively be combined into a single layer.

Other layers of the imaging member may include, for example, an optional ground strip layer applied to one edge of the imaging member to promote electrical continuity with the conductive layer 12 through the hole blocking layer 14. An anti-curl back coating layer 30 of the imaging member may be formed on the backside of the support substrate 10. The conductive ground plane 12 is typically a thin metallic layer, for example a 10 nanometer thick titanium coating, deposited over the substrate 10 by vacuum deposition or sputtering process. The layers 14, 16, 18, 20 and 26 may be separately and sequentially deposited on to the surface of conductive ground plane 12 of substrate 10 as solutions comprising a solvent, with each layer being dried before deposition of the next.

The Substrate

The imaging member support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of many different configurations, such as for example, a plate, a cylinder, a drum, a scroll, an endless flexible belt, and the like. In the case of the substrate being in the form of a belt, the belt can be seamed or seamless.

The thickness of the substrate 10 depends on numerous factors, including flexibility, mechanical performance, and economic considerations. The thickness of the support substrate 10 may range from about 25 micrometers to about 3,000 micrometers. In embodiments of flexible imaging member belt preparation, the thickness of substrate 10 is from about 50 micrometers to about 200 micrometers for optimum flexibility and to effect minimum induced imaging member surface bending stress when a imaging member belt is cycled around small diameter rollers in a machine belt support module, for example, 19 millimeter diameter rollers.

An exemplary substrate support 10 is not soluble in any of the solvents used in each coating layer solution, is optically transparent or semi-transparent, and is thermally stable up to a high temperature of about 150° C. A typical substrate support 10 used for imaging member fabrication has a thermal contraction coefficient ranging from about 1×10-5 per ° C. to about 3×10-5 per ° C. and a Young's Modulus of between about 5×10-5 psi (3.5×10-4 Kg/cm2) and about 7×10-5 psi (4.9×10-4 Kg/cm2).

The Conductive Layer

The conductive ground plane layer 12 may vary in thickness depending on the optical transparency and flexibility desired for the electrophotographic imaging member. When a imaging member flexible belt is desired, the thickness of the conductive layer 12 on the support substrate 10, for example, a titanium and/or zirconium conductive layer produced by a sputtered deposition process, typically ranges from about 2 nanometers to about 75 nanometers to allow adequate light transmission for proper back erase, and in embodiments from about 10 nanometers to about 20 nanometers for an optimum combination of electrical conductivity, flexibility, and light transmission. Generally, for rear erase exposure, a conductive layer light transparency of at least about 15 percent is desirable. The conductive layer need not be limited to metals. The conductive layer 12 may be an electrically conductive metal layer which may be formed, for example, on the substrate by any suitable coating technique, such as a vacuum depositing or sputtering technique. Typical metals suitable for use as conductive layer 12 include aluminum, zirconium, niobium, tantalum, vanadium, hafnium, titanium, nickel, stainless steel, chromium, tungsten, molybdenum, combinations thereof, and the like. Where the entire substrate is an electrically conductive metal, the outer surface can perform the function of an electrically conductive layer and a separate electrical conductive layer may be omitted. Other examples of conductive layers may be combinations of materials such as conductive indium tin oxide as a transparent layer for light having a wavelength between about 4000 Angstroms and about 9000 Angstroms or a conductive carbon black dispersed in a plastic binder as an opaque conductive layer.

The illustrated embodiment will be described in terms of a substrate layer 10 comprising an insulating material including inorganic or organic polymeric materials, such as, MYLAR with a ground plane layer 12 comprising an electrically conductive material, such as titanium or titanium/zirconium, coating over the substrate layer 10.

The Hole Blocking Layer

An optional hole blocking layer 14 may then be applied to the substrate 10 or to the layer 12, where present. Any suitable positive charge (hole) blocking layer capable of forming an effective barrier to the injection of holes from the adjacent conductive layer 12 into the photoconductive or charge generating layer may be utilized. The charge (hole) blocking layer may include polymers, such as, polyvinylbutyral, epoxy resins, polyesters, polysiloxanes, polyamides, polyurethanes, HEMA, hydroxylpropyl cellulose, polyphosphazine, and the like, or may comprise nitrogen containing siloxanes or silanes, or nitrogen containing titanium or zirconium compounds, such as, titanate and zirconate. The hole blocking layer should be continuous and may have a thickness in a wide range of from about 0.2 microns to about 10 micrometers depending on the type of material chosen for use in a imaging member design. Typical hole blocking layer materials include, for example, trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, (gamma-aminobutyl)methyl diethoxysilane which has the formula [H2N(CH2)4]CH3Si(OCH3)2, and (gamma-aminopropyl) methyl diethoxysilane, which has the formula [H2N(CH2)3] CH33Si(OCH3)$_2$, and combinations thereof, as disclosed, for example, in U.S. Pat. Nos. 4,338,387; 4,286,033; and 4,291,110, incorporated herein by reference in their entireties. An embodiment of a hole blocking layer comprises a reaction product between a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low RH. Other suitable charge blocking layer polymer compositions are also described in U.S. Pat. No. 5,244,762 which is incorporated herein by reference in its entirety. These include vinyl hydroxyl ester and vinyl hydroxy amide polymers wherein the hydroxyl groups have been partially modified to benzoate and acetate esters which are then blended with other unmodified vinyl hydroxy ester and amide unmodified polymers. An example of such a blend is a 30 mole percent benzoate ester of poly(2-hydroxyethyl methacrylate) blended with the parent polymer poly(2-hydroxyethyl methacrylate). Still other suitable charge blocking layer polymer compositions are described in U.S. Pat. No. 4,988,597, which is incorporated herein by reference in its entirety. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate).

The blocking layer 14 can be continuous or substantially continuous and may have a thickness of less than about 10 micrometers because greater thicknesses may lead to undesirably high residual voltage. In aspects of the exemplary embodiment, a blocking layer of from about 0.005 micrometers to about 2 micrometers gives optimum electrical performance. The blocking layer may be applied by any suitable conventional technique, such as, spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques, such as, by vacuum, heating, and the like. Generally, a weight ratio of blocking layer material and solvent of between about 0.05:100 to about 5:100 is satisfactory for spray coating.

The Adhesive Interface Layer

An optional separate adhesive interface layer 16 may be provided. In the embodiment illustrated in FIG. 1, an interface layer 16 is situated intermediate the blocking layer 14 and the charge generator layer 18. The interface layer may include a copolyester resin. Exemplary polyester resins which may be utilized for the interface layer include polyarylate and polyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interface layer 16 may be applied directly to the hole blocking layer 14. Thus, the adhesive interface layer 16 in embodiments is in direct contiguous contact with both the underlying hole blocking layer 14 and the overlying charge generator layer 18 to enhance adhesion bonding to provide linkage. In yet other embodiments, the adhesive interface layer 16 is entirely omitted.

Any suitable solvent or solvent mixtures may be employed to form a coating solution of the polyester for the adhesive interface layer 16. Typical solvents include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited wet coating may be effected by any suitable conventional process, such as oven drying, infra red radiation drying, air drying, and the like.

The adhesive interface layer 16 may have a thickness of from about 0.01 micrometers to about 900 micrometers after drying. In embodiments, the dried thickness is from about 0.03 micrometers to about 1 micrometer.

The Charge Generating Layer

The charge generating layer 18 may thereafter be applied to the adhesive layer 16. Any suitable charge generating binder including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous charge generating layer. Benzimidazole perylene compositions are well known and described, for example, in U.S. Pat. No. 4,587,189, the entire disclosure thereof being incorporated herein by reference. Multi-charge generating layer compositions may be utilized where a photoconductive layer enhances or reduces the properties of the charge generating layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the charge generating layer 18, including those described, for example, in U.S. Pat. No. 3,121,006, the entire disclosure thereof being incorporated herein by reference. Typical organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly (4,4'-dihydroxy-diphenyl-1-1-cyclohexane) which has a viscosity-molecular weight of 40,000 and is available from Mitsubishi Gas Chemical Corporation.

The charge generating material can be present in the resinous binder composition in various amounts. Generally, from about 5 percent by volume to about 90 percent by volume of the charge generating material is dispersed in about 10 percent by volume to about 95 percent by volume of the resinous binder, and more specifically from about 20 percent by volume to about 60 percent by volume of the charge generating material is dispersed in about 40 percent by volume to about 80 percent by volume of the resinous binder composition.

The charge generating layer 18 containing the charge generating material and the resinous binder material generally ranges in thickness of from about 0.1 micrometer to about 5 micrometers, for example, from about 0.3 micrometers to about 3 micrometers when dry. The charge generating layer thickness is generally related to binder content. Higher binder content compositions generally employ thicker layers for charge generation.

In embodiments, the charge generating layer may comprise a charge transport molecule or component, as discussed below in regards to the charge transport layer. The charge transport molecule may be present in some embodiments from about 0 percent to about 60 percent by weight of the total weight of the charge generating layer.

The Charge Transport Layer

The charge transport layer 20 is thereafter applied over the charge generating layer 18 and may include any suitable transparent organic polymer or non-polymeric material capable of supporting the injection of photogenerated holes or electrons from the charge generating layer 18 and capable of allowing the transport of these holes/electrons through the charge transport layer to selectively discharge the surface charge on the imaging member surface. In one embodiment, the charge transport layer 20 not only serves to transport holes, but also protects the charge generating layer 18 from abrasion or chemical attack and may therefore extend the service life of the imaging member. The charge transport layer 20 can be a substantially non-photoconductive material, but one which supports the injection of photogenerated holes from the charge generation layer 18. The layer 20 is normally transparent in a wavelength region in which the electrophotographic imaging member is to be used when exposure is effected therethrough to ensure that most of the incident radiation is utilized by the underlying charge generating layer 18. The charge transport layer should exhibit excellent optical transparency with negligible light absorption and negligible charge generation when exposed to a wavelength of light useful in xerography, e.g., 400 to 900 nanometers. In the case when the imaging member is prepared with the use of a transparent substrate 10 and also a transparent or partially transparent conductive layer 12, image wise exposure or erase may be accomplished through the substrate 10 with all light passing through the back side of the substrate. In this case, the materials of the layer 20 need not transmit light in the wavelength region of use if the charge generating layer 18 is sandwiched between the substrate and the charge transport layer 20. The charge transport layer 20 in conjunction with the charge generating layer 18 is an insulator to the extent that an electrostatic charge placed on the charge transport layer is not conducted in the absence of illumination. The charge transport layer 20 should trap minimal charges as the charge passes through it during the discharging process.

The charge transport layer 20 may include any suitable charge transport molecule or activating compound useful as an additive molecularly dispersed in an electrically inactive polymeric material to form a solid solution and thereby making this material electrically active. The charge transport molecule may be added to a film forming polymeric material which is otherwise incapable of supporting the injection of photogenerated holes from the charge generation material and incapable of allowing the transport of these holes through. This addition converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The charge transport molecule typically comprises small molecules of an organic compound which cooperate to transport charge between molecules and ultimately to the surface of the charge transport layer, for example, the charge transport molecule may be represented by the following structure:

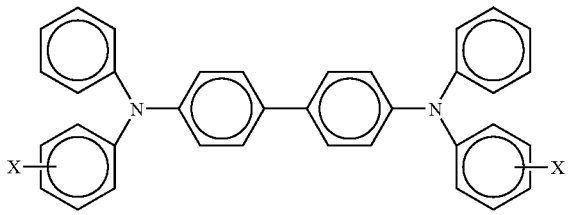

wherein X is selected from the group consisting of alkyl, alkoxy, and halogen. In embodiments the alkyl and alkoxy contain from about 1 to about 12 carbon atoms. In other embodiments, the alkyl contains from about 1 to about 5 carbon atoms. In yet another embodiment, the alkyl is methyl. In an embodiment, the charge transport molecule is (N,N'-diphenyl-N,N'-bis(3-methylphenyl)-(1,1'-biphenyl-)-4,4'diamine). The charge transport molecule may be present in some embodiments from about 0 percent to about 60 percent by weight of the total weight of the charge transport layer or in other embodiments from about 10 percent to about 60 percent by weight of the total weight of the charge transport layer.

In the embodiments, any suitable inactive polymer may also be used in the charge transporting layer.

Any suitable electrically inactive resin binder may be used to apply the charge transport layer. Typical inactive resin binders include polycarbonate resin, polystyrene, polyester, polyarylate, polyacrylate, polyether, polysulfone, and the like. Molecular weights can vary, for example, from about 20,000 to about 150,000. Examples of binders include polycarbonates such as poly(4,4'-isopropylidene-diphenylene) carbonate (also referred to as bisphenol-A-polycarbonate or PCA), poly(4,4'-cyclohexylidine-diphenylene)carbonate (referred to as bisphenol-Z polycarbonate or PCZ), poly(4,4'-isopropylidene-3,3'-dimethyl-diphenyl)carbonate (also referred to as bisphenol-C-polycarbonate) and the like and mixtures thereof.

Any suitable and conventional technique may be used to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Crosslinking agents can be used in combination with the charge transport layer to promote crosslinking of the polymer, thereby providing a strong bond. Examples of suitable crosslinking agents include acrylated polystyrene, methacrylated polystyrene, ethylene glycol dimethacrylate, Bisphenol A glycerolate dimethacrylate, (dimethylvinylsilyloxy)heptacyclopentyltricycloheptasiloxanediol, and the like, and mixtures thereof. The crosslinking agent can be used in an amount of from about 1 to about 20 percent, or from about 5 to about 10 percent, or about 8 to about 9 percent by weight of total polymer content.

In the present embodiments, nano polymeric gel particles are added to the charge transport layer in the imaging member to reduce the amount of charge transport molecule needed without affecting charge mobility. The nano polymeric gel particles are relatively simple to disperse, have extremely high surface area to unit volume ratio, have a larger interaction zone with the dispersing medium, are non-porous, and are chemically pure. Further, in embodiments, the nano-size filler is highly crystalline, spherical, and/or has a high surface area. The nano-size particles may have a surface area of from about 2 $m^2/g$ to about 200 $m^2/g$, or from about 4 $m^2/g$ to about 100 $m^2/g$.

In one embodiment, the charge transport molecule, such as N,N'-diphenyl-N,N'-bis(3-methylphenyl)-(1,1'-biphenyl-)-4,4'diamine, dispersed polycarbonate charge transport layer is embedded with nano-polymeric gel particles, such as crosslinked polystyrene-n-butyl acrylate copolymer, in an effort to increase its mechanical strength. The crosslinked polymeric gel particles are not soluble in the charge transporting solvents and will remain dispersed in the solution. The nano polymeric gel particles are soluble in tetrahydrofuran (THF), toluene, or some other organic solvents, but not in halogen solvents, such as methylene chloride. Single or multiple solvents may be used.

The embedded charge transport layer can be coated and dried as usual. A clear charge transport layer with much less curl can then be obtained after the drying of the coating. Embedding with the nano polymeric gel particles provides polymeric material reinforcement. In general, the resulting composites have excellent wear resistance and bending strength. Since the nano polymeric gel particles only function as a filler and charge transport molecules have very low solubility in them, the distance between the charge transport molecules in the binder is unchanged by the embedding. Thus, the particles will not impact the concentration of the charge transport molecule and charge mobility will be unaffected. With a proper solvent selection, the nano polymeric gel particles remain embedded in the matrix of binder, such as for example polycarbonate or polystyrene, with very little diffusion into the binder. Hence, charge transport molecule loading may be reduced without affecting its mobility or sacrificing the electrical properties. Consequently, less charge transport molecules are needed to achieve the same level of charge transport mobility.

As the nano polymeric gel particles are not soluble in methylene chloride, a thin precipitate film protects and/or stabilizes the nano gel particles/toluene nano-droplets. During the drying step, methylene chloride evaporates off first, and gives rise to a uniformly dispersed nano-size gel particle phase in the charge transport layer film. The binder and charge transport molecule have good miscibility, so the nano-size phase should be very stable in solid state. In the nano-size phase, there is no or very little charge transport molecules as most of the charge transport molecules remains in the binder. Because the high charge transport molecule concentration remains in the binder, and low or no charge transport molecule concentration remains in the nano-size phase, the charge migration takes place through the charge transport molecule/binder phase and mobility is not affected. As a result, the overall charge transport molecule to binder ratio is reduced while maintaining sufficient charge transport mobility.

In embodiments, the nano polymeric gel particle is added to the charge transport member in an amount of from about 0.1 to about 30 percent, from about 1 to about 15 percent, or from about 2 to about 10 percent by weight of the total solids.

Examples of nano polymeric gel particles include particles having an average particle size of from about 1 to about 250 nanometers, or from about 1 to about 199 nanometers, or from about 1 to about 195 nanometers, or from about 1 to about 175 nanometers, or from about 1 to about 150 nanometers, or from about 1 to about 100 nanometers, or from about 1 to about 50 nanometers.

Figure 2:
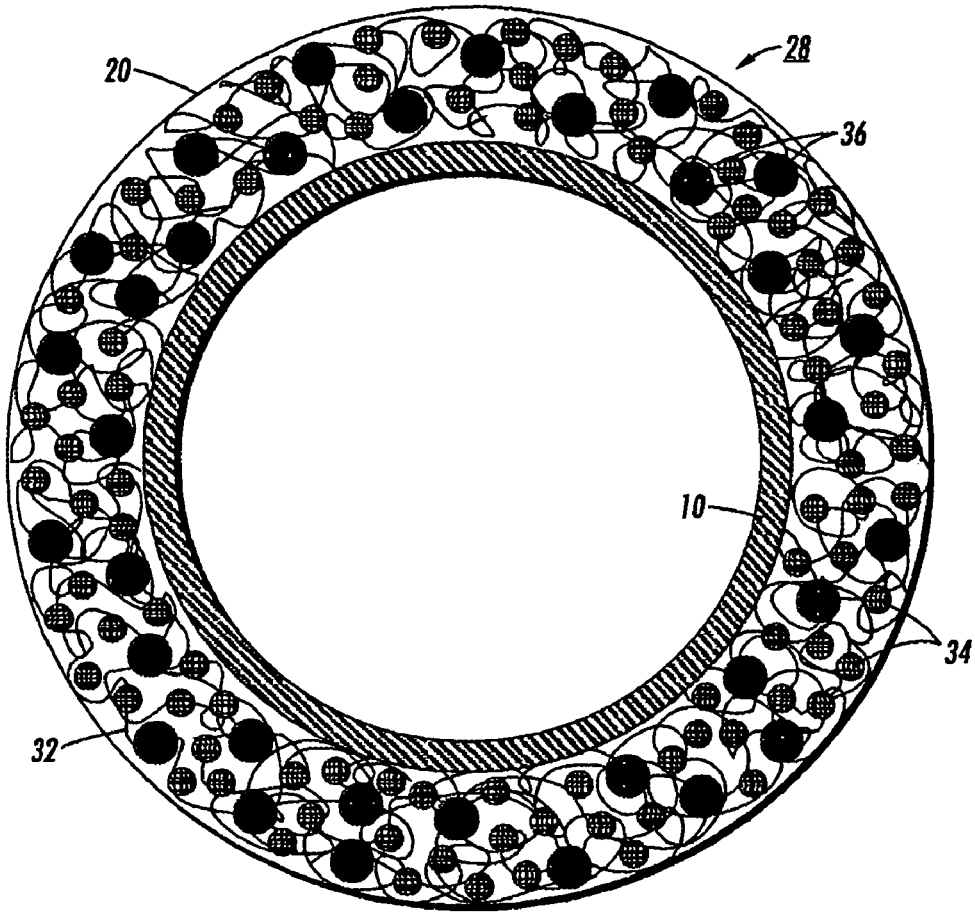
FIG. 2 is an enlarged view of a printing drum having a substrate and an imaging member layer thereon having nano-sized gel particles dispersed or contained in the layer according to an embodiment.

FIG. 2 illustrates an enlarged view of an embodiment, wherein the electrophotographic imaging member 28 comprises a substrate 10, having thereover charge transport layer 20 having nano polymeric gel particles 36 dispersed or contained therein. FIG. 2 illustrates the new structural design of a charge transport layer according to the embodiment. The charge transport layer 20 is shown as comprising a binder 32 and charge transport molecule 34. The nano polymeric gel particles 36, serving as fillers, are dispersed throughout the charge transport layer 20. In embodiments, these nano-polymeric gel particles are crosslinked polystyrene-n-butyl acrylate copolymers. In other embodiments, the imaging member layer having the nano polymeric gel particles dispersed therein may be layers other than the charge transport layer. For example, other layers that may incorporate the nanoparticles include, from FIG. 1, the overcoat layer 26 or the anti-curl back coating layer 30.

Other exemplary charge transport molecules include aromatic polyamines, such as aryl diamines and aryl triamines. Exemplary aromatic diamines include N,N'-diphenyl-N,N'-bis(alkylphenyl)-1,1'-biphenyl-4,4-diamines; (N,N'-diphenyl-N,N'-bis[3-methylphenyl]-[1,1'-biphenyl]-4,4'-diamine); N,N'-diphenyl-N,N'-bis(chlorophenyl)-1,1'-biphenyl-4,4'-diamine; and N,N'-bis-(4-methylphenyl)-N,N'-bis(4-ethylphenyl)-1,1'-3,3'-dimethylbiphenyl)-4,4'-diamine, N,N'-bis-(3,4-dimethylphenyl)-4,4'-biphenyl amine, and combinations thereof.

Further suitable charge transport molecules include pyrazolines, such as 1-[lepidyl-(2)]-3-(p-diethylaminophenyl)-5-(p-diethylaminophenyl)pyrazoline, as described, for example, in U.S. Pat. Nos. 4,315,982, 4,278,746, 3,837,851, and 6,214,514, substituted fluorene charge transport molecules, such as 9-(4'-dimethylaminobenzylidene)fluorene, as described in U.S. Pat. Nos. 4,245,021 and 6,214,514, oxadiazole transport molecules, such as 2,5-bis(4-diethylaminophenyl)-1,3,4-oxadiazole, pyrazoline, imidazole, triazole, as described, for example in U.S. Pat. No. 3,895,944, hydrazones, such as p-diethylaminobenzaldehyde (diphenylhydrazone), as described, for example in U.S. Pat. Nos. 4,150,987 4,256,821, 4,297,426, 4,338,388, 4,385,106, 4,387,147, 4,399,207, 4,399,208, 6,124,514, and tri-substituted methanes, such as alkyl-bis(N,N-dialkylaminoaryl)methanes, as described, for example, in U.S. Pat. No. 3,820,989. The disclosures of all of these patents are incorporated herein by reference in their entireties.

The concentration of the charge transport molecule in layer 20 may be, for example, at least about 5 weight percent and may comprise up to about 60 weight percent. The concentration or composition of the charge transport molecule may vary through layer 20, as described, for example, in U.S. application Ser. No. 10/736,864, filed Dec. 16, 2003, entitled "Imaging Members," by Anthony M. Horgan, et al., which was published on Jul. 1, 2004, as Application Serial No. 2004/0126684; U.S. application Ser. No. 10/320,808, filed Dec. 16, 2002, entitled "Imaging Members," by Anthony M. Horgan, et al., which was published on Jun. 17, 2004, as Application Serial No. 2004/0115545, and U.S. application Ser. No. 10/655,882, filed Sep. 5, 2003, entitled "Dual charge transport layer and photoconductive imaging member including the same," by Damodar M. Pai, et al., which was published on Mar. 10, 2005 as Application Serial No. 2005/0053854, the disclosures of which are incorporated herein by reference in their entireties.

In one exemplary embodiment, the charge transport layer 20 comprises an average of about 10-60 weight percent N,N'-diphenyl-N,N'-bis(3-methylphenyl)-1,1'-biphenyl-4,4'-diamine, such as from about 30-50 weight percent N,N'-diphenyl-N,N'-bis(3-methylphenyl)-1,1'-biphenyl-4,4'-diamine.

The charge transport layer 20 is an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer 20 to the charge generator layer 18 is maintained from about 2:1 to about 200:1 and in some instances as great as about 400:1.

Additional aspects relate to the inclusion in the charge transport layer 20 of variable amounts of an antioxidant, such as a hindered phenol. Exemplary hindered phenols include octadecyl-3,5-di-tert-butyl-4-hydroxyhydrociannamate, available as IRGANOX I-1010 from Ciba Specialty Chemicals. The hindered phenol may be present as up to about 10 weight percent based on the concentration of the charge transport molecule. Other suitable antioxidants are described, for example, in above-mentioned U.S. application Ser. No. 10/655,882 incorporated by reference.

In one specific embodiment, the charge transport layer 20 is a solid solution including a charge transport molecule, such as N,N'-diphenyl-N,N'-bis(3-methylphenyl)-1,1'-biphenyl-4,4'-diamine, molecularly dissolved in a polycarbonate binder, the binder being either a poly(4,4'-isopropylidene diphenyl carbonate) or a poly(4,4'-diphenyl-1,1'-cyclohexane carbonate).

The thickness of the charge transport layer 20 can be from about 5 micrometers to about 200 micrometers, e.g., from between about 15 micrometers and about 40 micrometers. The charge transport layer may comprise dual layers or multiple layers with different concentration of charge transporting components.

Other layers such as conventional ground strip layer 38 including, for example, conductive particles dispersed in a film forming binder may be applied to one edge of the imaging member to promote electrical continuity to the conductive layer 12. The ground strip layer 38 may include any suitable film forming polymer binder and electrically conductive particles. Typical ground strip materials include those enumerated in U.S. Pat. No. 4,664,995, the entire disclosure of which is incorporated by reference herein.

An overcoat layer 26 may also be utilized to provide imaging member surface protection, improved cleanability, reduced friction, as well as improve resistance to abrasion.

The Overcoat Layer

Additional aspects relate to overcoat layers that may comprise a dispersion of nanoparticles, such as silica, metal oxides, ACUMIST (waxy polyethylene particles), polytetrafluoroethylene (PTFE), and the like. The nanoparticles may be used to enhance the lubricity, scratch resistance, and wear resistance of the overcoat layer 26. In embodiments, the nanoparticles are comprised of nano polymeric gel particles of crosslinked polystyrene-n-butyl acrylate which is dispersed or embedded into a binder polymer matrix.

In embodiments, the overcoat layer may comprise a charge transport molecule or component. The charge transport molecule may be present in some embodiments from about 0 percent to about 60 percent by weight of the total weight of the overcoat layer.

In the larger printing apparatuses, adequate reduction of friction largely removes the need for additional members or components, subsequently reducing the cost of the imaging member. The overcoat layer 26 provides an outer level of protection on the imaging member and may help bolster wear resistance and scratch resistance of the charge transport layer in the print engine.

Any suitable and conventional technique may be utilized to form and thereafter apply the overcoat layer mixture to the imaging layer. Typical application techniques include, for example extrusion coating, draw bar coating, roll coating, wire wound rod coating, and the like. The overcoat layer 26 may be formed in a single coating step or in multiple coating steps. Drying of the deposited coating may be effected by any suitable conventional technique such as oven drying, infra red radiation drying, air drying and the like. The thickness of the dried overcoat layer may depend upon the abrasiveness of the charging, cleaning, development, transfer, etc. system employed and can range up to about 10 microns. In these embodiments, the thickness can be between about 0.5 microns and about 10 microns in thickness, or be between about 1 micron and about 5 microns. An overcoat can have a thickness of at most 3 microns for insulating matrices and at most 6 microns for semi-conductive matrices. However, the thickness of overcoat layers may be outside this range.

The Ground Strip

The ground strip 38 may comprise a film forming polymer binder and electrically conductive particles. Any suitable electrically conductive particles may be used in the electrically conductive ground strip layer. Typical electrically conductive particles include carbon black, graphite, copper, silver, gold, nickel, tantalum, chromium, zirconium, vanadium, niobium, indium tin oxide and the like. The electrically conductive particles may have any suitable shape. Typical shapes include irregular, granular, spherical, elliptical, cubic, flake, filament, and the like. In embodiments, the electrically conductive particles have a particle size less than the thickness of the electrically conductive ground strip layer 38 to avoid an electrically conductive ground strip layer 38 having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized. In addition, silica particles are typically included in the ground strip layer 38 to improve wear. However, in the present embodiments, nanoparticles are added in place of the silica particles. Nanoparticles of, for example, MAKROLON, can reduce electrostatic charge buildup and enhance wear resistance of the ground strip layer 38. In these embodiments, the nanoparticles comprised of polymeric gel particles are dispersed or embedded into a binder polymer matrix, such as PCZ. In embodiments, the ground strip layer may comprise a charge transport molecule or component. The charge transport molecule may be present in some embodiments from about 0 percent to about 60 percent by weight of the total weight of the ground strip layer. The ground strip layer 38 may have a thickness from about 7 micrometers to about 42 micrometers, or from about 14 micrometers to about 27 micrometers.

The Anti-Curl Back Coating Layer

In some cases, an anti-curl back coating may be applied to the surface of the substrate opposite to that bearing the photoconductive layer to provide flatness and/or abrasion resistance where a web configuration imaging member is fabricated. These overcoatings and anti-curl back coating layers are well known in the art, and can comprise thermoplastic organic polymers or inorganic polymers that are electrically insulating or slightly semiconductive. The thickness of anti-curl back coating layers is generally sufficient to balance substantially the total forces of the layer or layers on the opposite side of the substrate layer. An example of an anti-curl back coating layer is described in U.S. Pat. No. 4,654,284, the disclosure of which is totally incorporated herein by reference. A thickness of from about 70 to about 160 micrometers is a typical range for flexible imaging members, although the thickness can be outside this range.

Because conventional anti-curl back coating formulations often suffer from electrostatic charge build up due to contact friction between the anti-curl layer and the backer bars, which increases the friction and wear, incorporation of nano polymeric gel particles into the anti-curl back coating layer substantially eliminates this occurrence. In addition to reducing the electrostatic charge build up and reducing wear in the layer, the nano polymeric gel particles may be used to enhance the lubricity, scratch resistance, and wear resistance of the anti-curl back coating layer 30. In embodiments, the nano polymeric gel particles are comprised of crosslinked polystyrene-n-butyl acrylate, which is dispersed or embedded into a binder polymer matrix.

In embodiments, the anti-curl back coating layer may comprise a charge transport molecule or component. The charge transport molecule may be present in some embodiments from about 0 percent to about 60 percent by weight of the total weight of the anti-curl back coating layer.

All the patents and applications referred to herein are hereby specifically, and totally incorporated herein by reference in their entirety in the instant specification.

EXAMPLES

The examples set forth hereinbelow are being submitted to illustrate embodiments of the present disclosure. These examples are intended to be illustrative only and are not intended to limit the scope of the present disclosure. Also, parts and percentages are by weight unless otherwise indicated. Comparative examples and data are also provided.

Example 1

An imaging member was prepared by providing a 0.02 micrometer thick titanium layer coated on a biaxially oriented polyethylene naphthalate substrate (KALEDEX 2000) having a thickness of 3.5 mils. Applied thereon with a gravure applicator, was a solution containing 50 grams 3-amino-propyltriethoxysilane, 41.2 grams water, 15 grams acetic acid, 684.8 grams of 200 proof denatured alcohol and 200 grams heptane. This layer was then dried for about 2 minutes at 120° C. in the forced air drier of the coater. The resulting blocking layer had a dry thickness of 500 Angstroms.

An adhesive layer was then prepared by applying a wet coating over the blocking layer, using a gravure applicator, containing 0.2 percent by weight based on the total weight of the solution of polyarylate adhesive (Ardel D100 available from Toyota Hsutsu Inc.) in a 60:30:10 volume ratio mixture of tetrahydrofuran/monochlorobenzene/methylene chloride. The adhesive layer was then dried for about 2 minutes at 120° C. in the forced air dryer of the coater. The resulting adhesive layer had a dry thickness of 200 angstroms.

A photogenerating layer dispersion was prepared by introducing 0.45 grams of LUPILON200 (PC-Z 200) available from Mitsubishi Gas Chemical Corp and 50 ml of tetrahydrofuran into a 4 oz. glass bottle. To this solution was added 2.4 grams of hydroxygallium phthalocyanine and 300 grams of ⅛ inch (3.2 millimeter) diameter stainless steel shot. This mixture was then placed on a ball mill for 8 hours. Subsequently, 2.25 grams of PC-Z 200 was dissolved in 46.1 gm of tetrahydrofuran, and added to this OHGaPc slurry. This slurry was then placed on a shaker for 10 minutes. The resulting slurry was, thereafter, applied to the adhesive interface with a Bird applicator to form a charge generation layer having a wet thickness of 0.25 mil. However, a strip about 10 mm wide along one edge of the substrate web bearing the blocking layer and the adhesive layer, was deliberately left uncoated without any photogenerating layer material, to facilitate adequate electrical contact by the ground strip layer that was to be applied later. The charge generation layer was dried at 120° C. for 1 minute in a forced air oven to form a dry charge generation layer having a thickness of 0.4 micrometer.

The charge generator layer was coated with a charge transport layer. In a 120 ml amber bottle, 10 grams of MAKROLON 5705 (available from Bayer Chemicals) was dissolved in 113 grams of methylene chloride. After the polymer was completely dissolved, 10 grams of N,N'-diphenyl-N,N'-bis(3-methylphenyl)-1,1'-biphenyl-4-4'-diamine was added to the solution. The mixture was shaken overnight to assure a complete solution. The solution was applied onto the photogenerating layer using a 4.5 mil Bird bar to form a coating. The coated device was then heated in a forced air oven at 120° C. for 1 minute to form a charge transport layer having a dry thickness of 27.3 micrometers.

Example 2

Sample Preparation of Polymer Gel Solution 75 grams of toluene were added into a 250-ml flask, containing 20 grams of styrene, 5 grams of n-butyl acrylate, 0.1 gram of 1,10-decanediol diacrylate and 0.05 gram of free radical initiator bis(4-tert.butylcyclohexyl)peroxydicarbonate. The mixture was heated under nitrogen atmosphere (constant nitrogen gas purging) to 120° C. for 5 hours with a constant magnetic stirring. After being cooled to room temperature, the polymer gel solution was obtained. The solid content of this solution was about 25 weight percent.

Example 3

Sample Preparation of Nano-Polymeric Gel Reinforced Charge Transport (CTL) Layer In a 30 ml amber bottle, 1.5 grams of N,N'-diphenyl-N,N'-bis(3-methylphenyl)-1,1'-biphenyl-4-4'-diamine, 1.5 grams of MAKROLON 5705 and 3.0 gram of polymer gel solution prepared in Example 2, were dissolved in 17 grams of methylene chloride. After being ball milled for overnight, the charge transport solution was ready for coating. This solution was applied onto the charge generation layer (CGL) with a 4.5-mil gap bar and then dried at 120° C. for 1 minute. The thickness of this CTL was 22.2 microns. Very little curl was observed as compared to Example 1, which showed significant curl after drying.

Comparative Example 1

Electrical Test

The imaging member device of Example 3 with nano polymer gel reinforced CTL was tested for xerographic properties, at 40 percent RH and 21.1° C. As a comparison, control Example 1 with 50/50 CTL (thickness of 27.3 microns) was also tested under the same condition.

The flexible photoreceptor sheets prepared as described in Examples 1 and 3 were tested for their xerographic sensitivity and cyclic stability in a scanner. In the scanner, each photoreceptor sheet to be evaluated was mounted on a cylindrical aluminum drum substrate, which was rotated on a shaft. The devices were charged by a corotron mounted along the periphery of the drum. The surface potential was measured as a function of time by capacitively coupled voltage probes placed at different locations around the shaft. The probes were calibrated by applying known potentials to the drum substrate. Each photoreceptor sheet on the drum was exposed to a light source located at a position near the drum downstream from the corotron. As the drum was rotated, the initial (pre-exposure) charging potential (Vddp) was measured by voltage probe 1. Further rotation lead to an exposure station, where the photoreceptor device was exposed to monochromatic radiation to obtain a photoinduced discharge curve (PIDC) of Vddp versus ergs/cm$^2$. S is the initial slope of the PIDC, Vc is the Vddp on the curve where the slope is ½ of S. The devices were erased by a light source located at a position upstream of charging to obtain Vr. The dark decay is the discharge without illumination in volts/sec. The devices were charged to a negative polarity corona. After 10,000 charge-erase cycles the measurements were repeated. The test results are summarized in the following Tables 1 and 2.

TABLE 1

PIDC data for new imaging member

| Sample | V0 | S | Vc | Vr | Vdepl | Vdd |
|---|---|---|---|---|---|---|
| Example 1 | 599.7 | 379.2 | 139.2 | 42.2 | 17.4 | 37.2 |
| Example 3 | 599.5 | 319.9 | 137.9 | 38.5 | 16.4 | 24.6 |

TABLE 2

PIDC data after 10k Cycling test

| Sample | V0 | S | Vc | Vr | Vdepl | Vdd |
|---|---|---|---|---|---|---|
| Example 1 | 600.2 | 367.6 | 210.2 | 70.3 | 37.6 | 27.3 |
| Example 3 | 600.1 | 309.3 | 194.7 | 88.3 | 54.7 | 18.5 |

The new device with nano-polymeric gel particles in CTL showed very good charging and discharging performance, similar to the control. The difference in the S value is due to the difference in thickness.

The charge transport mobility of Example 3 was also shown to be comparable to those of 50/50 imaging member control of Example 1.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An imaging member, comprising:

a substrate;

a charge generating layer disposed on the substrate;

a charge transport layer disposed on the charge generating layer;

an overcoat layer disposed on the charge transport layer;

an anti-curl back coating layer disposed on the substrate opposite to the charge transport layer; and a ground strip layer disposed on one edge of the imaging member, wherein the charge transport layer comprises a polycarbonate resin embedded with nano polymeric gel particles, and further wherein the nano polymeric particles comprise crosslinked polystyrene-n-butyl acrylate copolymers.

2. The imaging member of claim 1 further including a charge transport molecule present in at least one of the charge generating layer, the charge transport layer, the overcoat layer, the anti-curl back coating layer, and the ground strip layer from about 0 percent to about 60 percent weight of the total weight of the respective layer.

3. The imaging member of claim 2, wherein the charge transport molecule comprises:

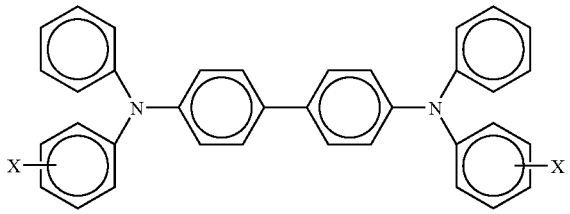

wherein X is selected from the group consisting of alkyl, alkoxy, and halogen.

4. The imaging member of claim 2, wherein the charge transport molecule is present in an amount of from about 10 percent to about 60 percent weight of the total weight of the charge transport layer.

5. The imaging member of claim 4, wherein the charge transport molecule is present in an amount of from about 30 percent to about 60 percent weight of the total weight of the charge transport layer.

6. The imaging member of claim 1, wherein the nano polymeric gel particles have a particle size of from about 1 to about 199 nanometers.

7. The imaging member of claim 6, wherein the nano polymeric gel particles have a particle size of from about 1 to about 100 nanometers.

8. The imaging member of claim 1, wherein the nano polymeric gel particles have a surface area of from about 2 m$^2$/g to about 200 m$^2$/g.

9. The imaging member of claim 1, wherein the nano polymeric gel particles are present in the charge transport layer from about 0.1 percent to about 30 percent weight of the total weight of the charge transport layer.

10. The imaging member of claim 1, wherein the polycarbonate resin is bisphenol-Z-polycarbonate.

11. The imaging member of claim 1, wherein the charge transport layer has a thickness of from about 5 microns to about 40 microns.

12. The imaging member of claim 1, wherein the overcoat layer has a thickness of from about 0.2 micron microns to about 4 microns.

13. The imaging member of claim 1, wherein the anti-curl back coating layer has a thickness of from about 5 microns to about 40 microns.

14. An imaging member, comprising:

a substrate;

a charge generating layer disposed on the substrate;

a charge transport layer disposed on the charge generating layer;

an overcoat layer disposed on the charge transport layer;

an anti-curl back coating layer disposed on the substrate opposite to the charge transport layer; and a ground strip layer disposed on one edge of the imaging member, wherein the charge transport layer comprises a polycarbonate resin embedded with nano polymeric gel particles comprising crosslinked polystyrene-n-butyl acrylate copolymers, and further wherein the nano polymeric gel particles have an average particle size of from about 1 nanometer to about 250 nanometers.

15. The imaging member of claim 14 further including a charge transport molecule present in at least one of the charge generating layer, the charge transport layer, the overcoat layer, the anti-curl back coating layer, and the ground strip layer from about 0 percent to about 60 percent weight of the total weight of the respective layer.

16. The imaging member of claim 15, wherein the charge transport molecule comprises:

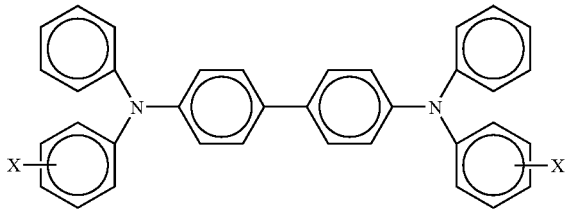

wherein X is selected from the group consisting of alkyl, alkoxy, and halogen.

17. The imaging member of claim 15, wherein the charge transport molecule is present in an amount of from about 10 percent to about 60 percent weight of the total weight of the charge transport layer.

18. The imaging member of claim 17, wherein the charge transport molecule is present in an amount of from about 30 percent to about 60 percent weight of the total weight of the charge transport layer.

19. The imaging member of claim 14, wherein the nano polymeric gel particles are present in the charge transport layer from about 0.1 percent to about 30 percent weight of the total weight of the charge transport layer.

20. The imaging member of claim 14, wherein the polycarbonate resin is bisphenol-Z-polycarbonate.

21. The imaging member of claim 14, wherein the charge transport layer has a thickness of from about 5 microns to about 40 microns.

22. The imaging member of claim 14, wherein the overcoat layer has a thickness of from about 0.2 micron microns to about 4 microns.

23. The imaging member of claim 14, wherein the anti-curl back coating layer has a thickness of from about 5 microns to about 40 microns.

* * * * *